US005680835A

United States Patent [19]

Ruffing et al.

[11] Patent Number: 5,680,835

[45] Date of Patent: Oct. 28, 1997

[54] ROCKER ASSEMBLY WITH INTERCONNECTABLE ARMS

[75] Inventors: Wolfgang Ruffing, Unterschleissheim; Uwe Hoyer, Rohrbach, both of Germany

[73] Assignee: Bayerische Motoren Werke Aktiengesellschaft, Germany

[21] Appl. No.: 596,178

[22] PCT Filed: Jul. 4, 1994

[86] PCT No.: PCT/EP94/02184

§ 371 Date: Feb. 5, 1996

§ 102(e) Date: Feb. 5, 1996

[87] PCT Pub. No.: WO95/04873

PCT Pub. Date: Feb. 16, 1995

[30] Foreign Application Priority Data

Aug. 5, 1993 [DE] Germany ..... 43 26 332.1

[51] Int. Cl.[6] ..... F01L 1/26

[52] U.S. Cl. ..... 123/90.16; 123/90.27; 123/90.36; 123/193.3; 123/90.22

[58] Field of Search ..... 123/90.15, 90.16, 123/90.17, 90.22, 90.27, 90.33, 90.35, 90.36, 90.38, 90.39, 90.42, 90.44, 193.3, 193.5

[56] References Cited

U.S. PATENT DOCUMENTS

| | | | |
|---|---|---|---|
| 4,537,166 | 8/1985 | Kimura et al. | 123/90.27 |
| 4,655,177 | 4/1987 | Wells et al. | 123/90.36 |
| 4,730,588 | 3/1988 | Maeda | 123/90.16 |
| 4,848,285 | 7/1989 | Konno | 123/90.16 |
| 4,887,563 | 12/1989 | Ishida et al. | 123/90.16 |
| 4,917,056 | 4/1990 | Yagi et al. | 123/90.16 |
| 5,005,544 | 4/1991 | Spangler | 123/193.5 |
| 5,095,861 | 3/1992 | Dove, Jr. | 123/193.5 |
| 5,172,674 | 12/1992 | Horie et al. | 123/571 |
| 5,386,806 | 2/1995 | Allen et al. | 123/90.16 |

FOREIGN PATENT DOCUMENTS

| | | |
|---|---|---|
| 0 213 758 | 3/1987 | European Pat. Off. . |
| 0 259 106 | 3/1988 | European Pat. Off. . |
| 0 267 696 | 5/1988 | European Pat. Off. . |
| 0 364 069 | 4/1990 | European Pat. Off. . |

OTHER PUBLICATIONS

Patent Abstracts of Japan, vol. 11, No. 10 (M-552) (2547) 10 Jan. 1987 JP, A, 61-185,605 (Suzuki) 19 Aug. 1986.

*Primary Examiner*—Weilun Lo

*Attorney, Agent, or Firm*—Evenson, McKeown, Edwards & Lenahan P.L.L.C.

[57] ABSTRACT

A rocker assembly includes a central arm and two outer arms supported on a rocker shaft portion, and a plurality of supporting brackets. The arms, which are actuated by respective cams, actuate at least two lifting valves of a cylinder of an internal combustion engine. Both outer arms may be independently hydraulically coupled by bolt elements to the central arm. Hydraulic ducts extend through the supporting brackets, the rocker shaft portion and the outer arms to communicate with the coupling bolts. The rocker arms, the rocker shaft portion, and the supporting brackets form a pre-assembly unit. The central arm may have a roller on which an associated cam rolls, with the bolt elements of the central arm being arranged coaxially to the roller inside the roller.

13 Claims, 4 Drawing Sheets

ROCKER ASSEMBLY WITH INTERCONNECTABLE ARMS

BACKGROUND AND SUMMARY OF THE INVENTION

This invention relates to a rocker for actuating at least two lifting valves of an internal-combustion engine with three arms which can be swivelled separately about a common rocker axis and which each have a contact surface for a cam and can be connected by bolt elements which can be hydraulically displaced essentially in parallel to the rocker axis, in the two outer arms, one coupling bolt respectively being provided which can be acted upon hydraulically in a separate manner and to which, in each case, a spring-loaded restoring bolt is assigned which is arranged in the central arm.

From European Patent Document EP 0 259 106 A1, such a rocker is known by means of which the lifting valves of an internal-combustion engine cylinder by switching over the bolt elements can be actuated by several cams. It is an object of the invention to provide additional improvements for such a rocker.

This object has been achieved according to the present invention by forming a preassembly unit from the rocker arms, a rocker shaft piece, and two supporting brackets for the rocker shaft piece, and by guiding the hydraulic ducts by way of the supporting brackets and the rocker shaft piece through the outer arms for supplying the coupling bolts.

According to an advantageous further development, the contact surface of the central arm may be constructed as a rotatable roller in which the spring-loaded restoring bolts are arranged. In addition, the cam contact surfaces of the outer arms may be constructed as sliding pads.

This as well as other advantages and characteristics which may be significant with respect to the invention are explained by means of a preferred embodiment.

DETAILED DESCRIPTION OF THE DRAWINGS

Figure 1:
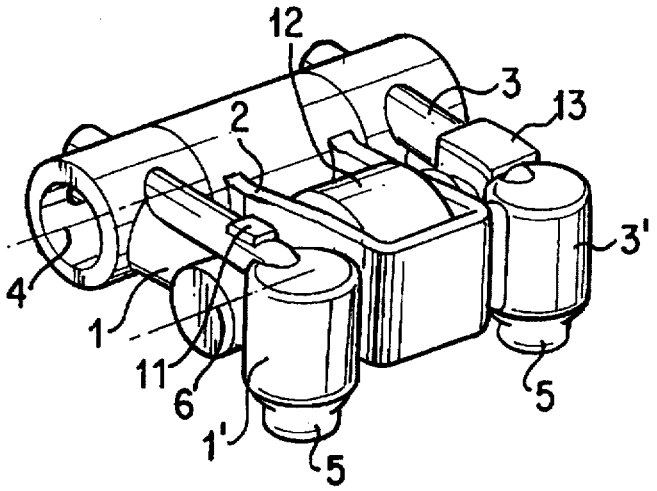
FIG. 1 is a perspective view of a rocker according to a preferred embodiment of the invention.

Three arms 1, 2, 3 of a rocker or of a rocker assembly, which are disposed next to one another and can be swivelled about a common axis, actuate two lifting valves of an internal-combustion engine, which are not shown. As known, these lifting valves are supported by means of their shaft ends on hydraulic-play-compensating elements 5 which are inserted into corresponding receiving devices 1', 3' on the free ends of the two outer arms 1, 3.

Each arm of the rocker assembly has a contact surface 11, 12, 13 for a cam, which is not shown, of a camshaft, which is also not shown. In this case, the contact surfaces 11, 13 of the outer arms 1, 3 are constructed as sliding pads, while the contact surface 12 of the central arm is constructed as a roller which can be rotated about a secondary axis 6. If the individual arms 1, 2, 3 are separated from one another, that is, can be swivelled independently of one another about the rocker axis 4, as a result of the rolling movement of the cams on the contact surfaces 11, 12, 13, all arms 1, 2, 3 are swivelled corresponding to the respective cam contour so that, in this case, the respective lifting valve assigned to the arms 1, 3 is actuated corresponding to the respective cam contour.

However, it is also possible to connect the arm 2 with the arm 1 and/or the arm 3, that is, to couple the arms 2 and 1 and/or the arms 2 and 3 to one another in such a manner that, during a swivel movement of arm 2, arm 1 and/or arm 3 is also taken along. If then the travel course of the cam rolling on the contact surface/roller 12 overlaps the travel courses of the cams assigned to the contact surfaces 11, 13, during the coupling of the arms 1, 3 to the arm 2, the lifting valves actuated by the arms 1, 3 are actuated corresponding to the course of the travel of the cam rolling on the roller 12.

Figure 2:
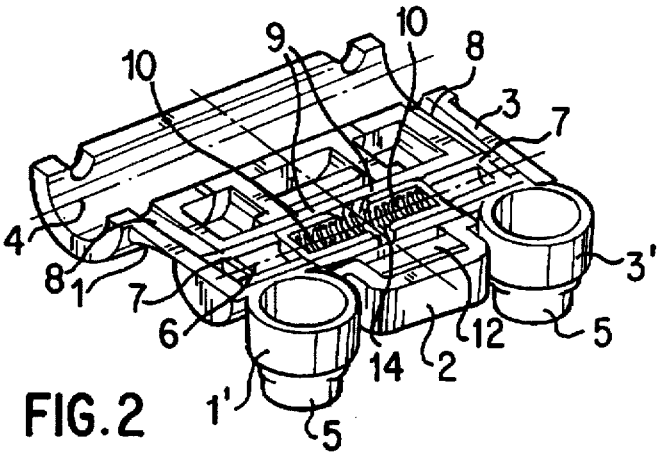
FIG. 2 is a sectional view similar to FIG. 1.
Figure 3:
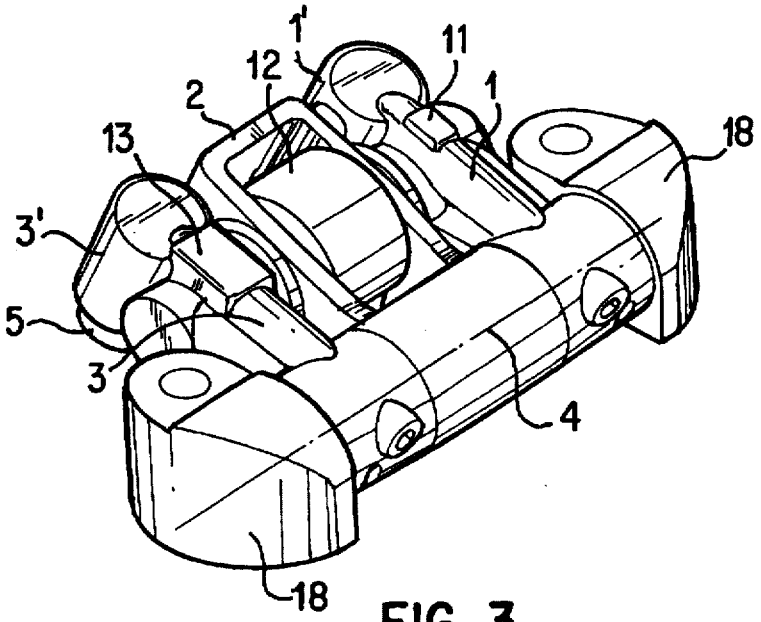
FIG. 3 is a view of this rocker according to the invention with the supporting brackets.
Figure 4:
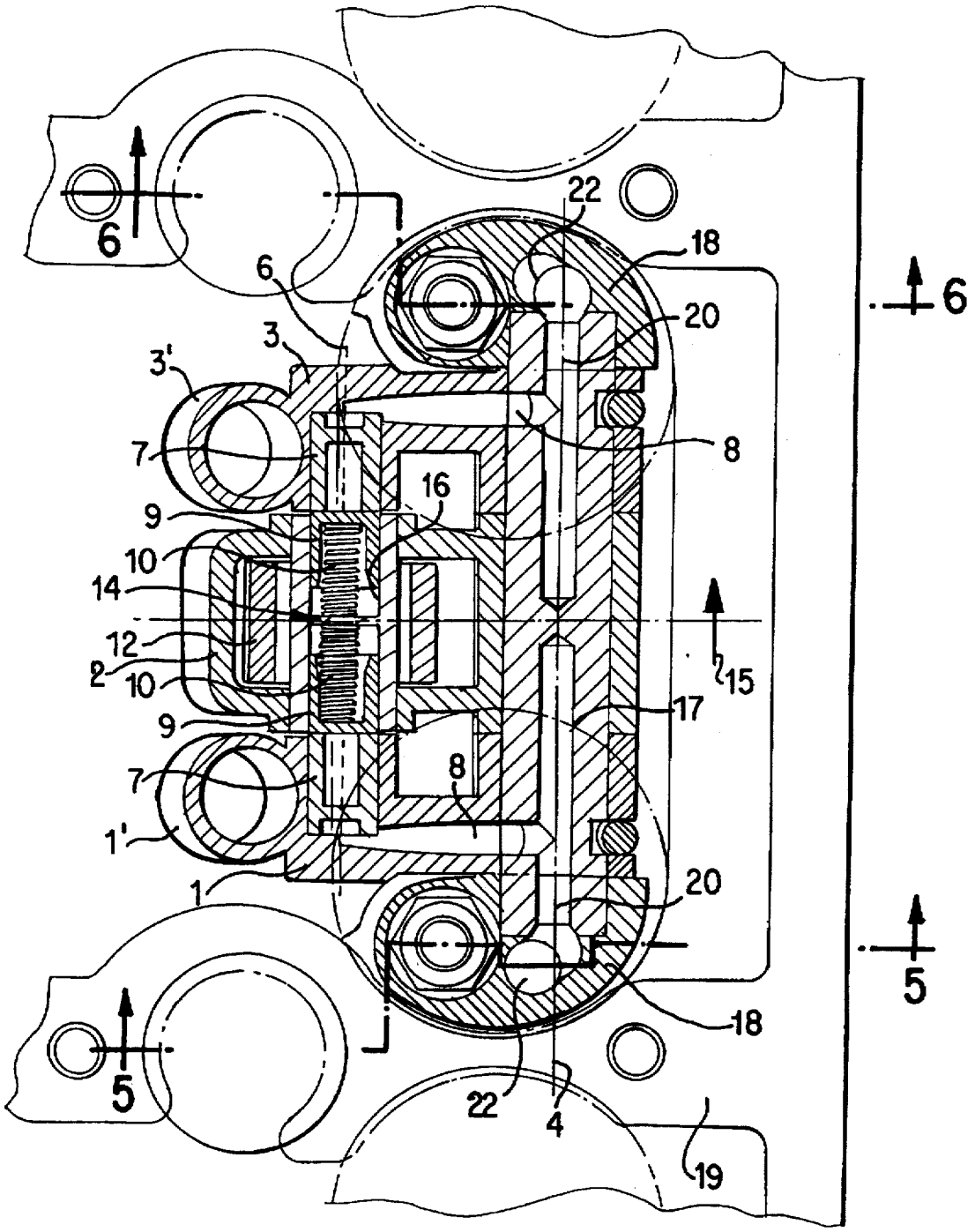
FIG. 4 is a sectional view similar to FIG. 1 including the supporting brackets in a plane representation.

The mechanism for coupling the arms 1 and/or 3 to arm 2 is illustrated particularly in FIGS. 2, 4. As indicated, one coupling bolt 7 respectively, which can be longitudinally displaced in the direction of the secondary axis 6, is arranged in the arms 1, 3 coaxially with respect to the secondary axis 6 which extends in parallel to the rocker axis 4. By way of a hydraulic duct 8, which extends in the respective arm 1, 3, each coupling bolt 7 can be acted upon on the outer side by a hydraulic medium and, as a result, can be displaced along the secondary axis 6. By means of its end situated opposite the hydraulic duct 8, each coupling bolt 7 rests on a restoring bolt 9 which, by way of a spring element 10, is supported on a symmetrical partition 14 in the arm 2. The diameter of each coupling bolt 7 is equal to the diameter of the assigned restoring bolt 9 so that, by being acted upon by hydraulic pressure, the coupling bolt 7 can be pushed partially into the receiving bore 16 for the restoring bolt 9 which is provided in the arm 2.

If therefore the coupling bolt 7 of the arm 1 as well as the coupling bolt 7 of the arm 3 are in the illustrated position in which, among other things, they are held by means of the respective assigned restoring bolt 9, the three arms 1, 2, 3 of the rocker assembly are uncoupled from one another and can be swivelled independently of one another about the rocker axis 4. In contrast, if, by means of the hydraulic supply acted upon by pressure, by way of the hydraulic duct 8, the coupling bolt 7 of the arm 1 is pressed in the direction of the arrow 15 partially into the receiving bore 16 of the arm 2, the assigned restoring bolt 9 is also displaced and the spring element 10 is compressed. As a result, since the coupling bolt 7 is then situated in arm 1 as well as in arm 2, arm 1 is coupled to arm 2 so that the two arms 1, 2 can only be swivelled together. However, the arm 3 can still be swivelled independently and freely in this stage.

However, as an alternative or simultaneously, hydraulic medium, which is acted upon by pressure, may also be supplied by way of the hydraulic duct 8 in the arm 3 so that also the coupling bolt 7 in the arm 3 is partially pushed into the receiving bore 16 of the arm 2 and in this case also displaces the assigned restoring bolt 9 and compresses the assigned spring element 10. As an alternative or in addition, the arm 3 is in this case also coupled to the arm 2. With the release of the hydraulic pressure in the hydraulic ducts 8 in the arm 1 and/or the arm 3, this coupled connection is released again because then, under the effect of the respective spring element 10, the respective restoring bolt 9 will push the respective coupling bolt 7 back into the respective arm 1, 3 into the illustrated position.

By means of the shown rocker assembly, it is therefore not only possible to either actuate the arms 1, 3 independently of one another or to couple only the arm 1 or only the arm 3 or both arms 1, 3 to arm 2, but, in addition, this rocker assembly is distinguished by an extremely compact construction. On the one hand, this extremely compact construction is achieved in that bolt elements, specifically the two restoring bolts 9 including the assigned spring elements 10, are essentially arranged inside the roller 12. On the other hand, it is also recognized that it is sufficient to construct only the contact surface 12 of the arm 2 as a roller while sliding pads are sufficient for the contact surfaces 11, 13 of the arms 1, 3.

As explained above, the travel course of the cam assigned to the arm 2 overlaps with the travel courses of the cams assigned to the arms 1, 3. Therefore, the cam of the arm 2, particularly in the high rotational speed range of the internal-combustion engine, must actuate the lifting valves which are not shown, while, in the low rotational speed range of the internal-combustion engine, the cams assigned to the arms 1, 3 actuate the lifting valves. Since the arms 1, 3 are coupled to the arm 2 preferably at the higher rotational speeds of the internal-combustion engine, as explained in the following, this coupling can definitely take place in steps. Significant valve actuating forces on the contact surface/roller 12 also only take place at these higher rotational speeds of the internal-combustion engine. As desired, the roller therefore acts here as an element which reduces the frictional losses. In contrast, in the case of low rotational speeds of the internal-combustion engine, the frictional losses between a cam and the contact surface 11, 13 of the assigned rocker arm 1, 3 are relatively low anyhow. However, since these contact surfaces 11, 13 become operative only at low rotational speeds of the internal-combustion engine within the scope of the actuating of the valves, no rollers are required for these contact surfaces 11, 13 and sliding pads are completely sufficient.

As indicated above, the coupling of the arms 1, 3 to arm 2 make take place in steps. In this case, the circuit logic permits a combination of a valve switch-off, a partial travel and a full valve travel. When the arm 1 is uncoupled from the assembly, the pertaining valve is essentially switched off. However, in order to prevent an accumulation of fuel in front of the lifting valve, it is required to open this valve by a minimal amount which is caused by a corresponding cam acting upon the narrow contact surface 11 of the arm 1. When the arm 3 is uncoupled, the valve assigned to this arm carries out a partial lift by means of the assigned cam which acts upon the wider contact surface 13. In this case, in a lower rotational speed and load range of the internal-combustion engine, both arms are uncoupled so that the first lifting valve is essentially (this is, with the exception of the minimal opening lift) switched off and the second internal-combustion engine valve carries out a partial lift. In a medium rotational speed and load range of the internal-combustion engine, the arm 3 is coupled to the arm 2 so that now, because of the effect of the cam assigned to the arm 2 on the roller 12, the second valve carries out a full lift, while the first internal-combustion engine valve remains switched off. In addition, in an upper rotational speed and load range of the internal-combustion engine, the arm 1 is coupled to the arm 2 so that now the two internal-combustion engine valves will carry out a full lift corresponding to the cam acting upon the roller 12.

The arms 1, 2, 3 form a preassembly unit together with a rocker shaft portion 17, on which the three arms 1, 2, 3 of the rocker assembly are disposed, as well as together with the two supporting brackets 18 for the rocker shaft portion 17. By way of the supporting brackets 18, this preassembly unit, as a separate subassembly, can simply be screwed to a cylinder head 19 of an internal-combustion engine which is shown only as a fragment. For this purpose, a retaining clip may be provided which prevents that this subassembly will fall apart during assembly work. This retaining clip may also be removable.

Figure 5:
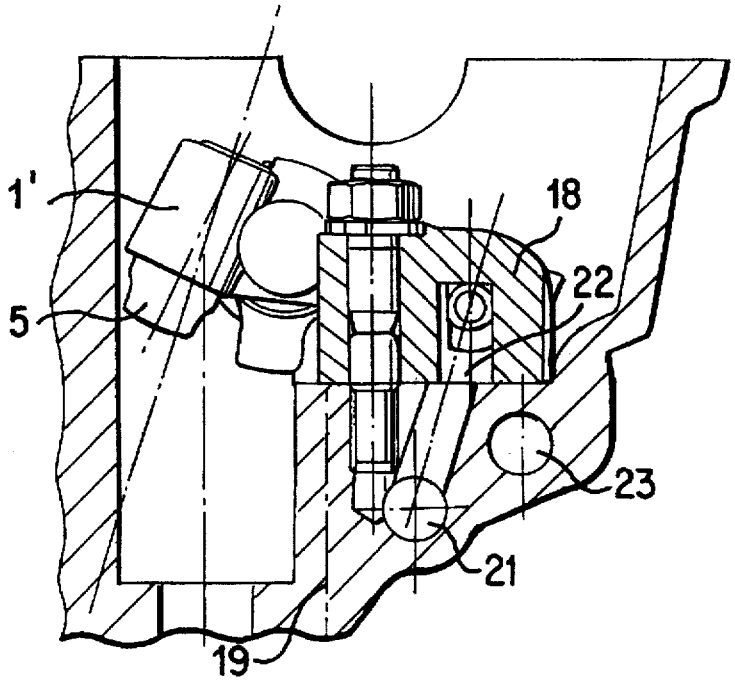
FIG. 5 is the sectional view A—A of FIG. 4.
Figure 6:
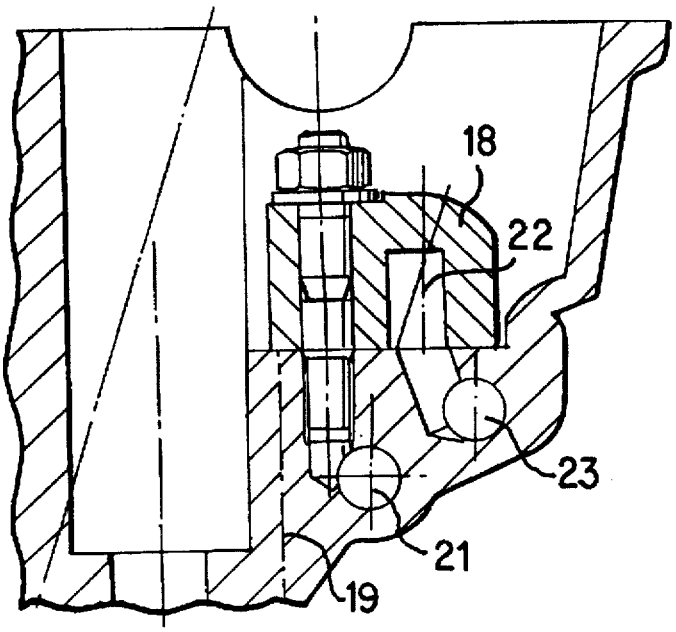
FIG. 6 is the sectional view B—B of FIG. 4.
Figure 7B:
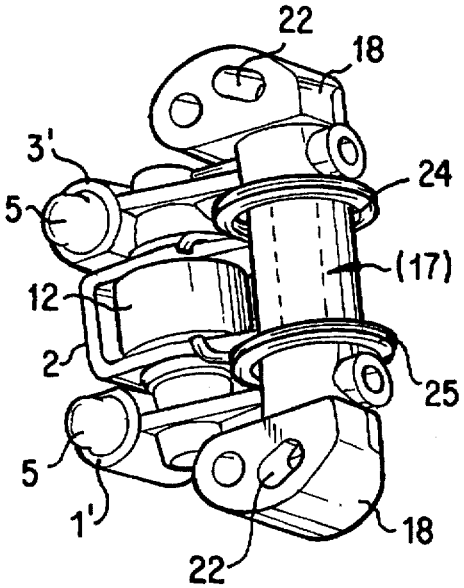
FIG. 7*b* is a perspective view from below of another rocker assembly which, additionally, has coil spring elements.
Figure 8B:
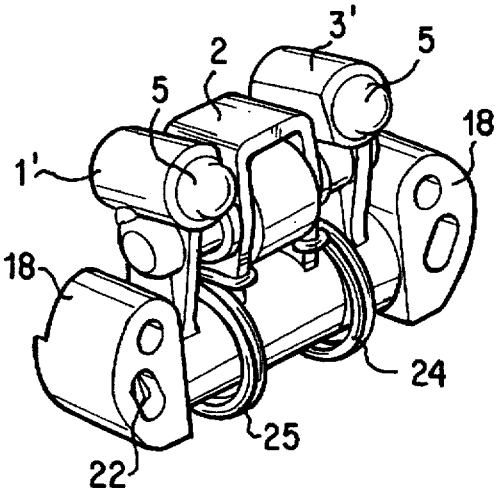
FIGS. 8*a*, 8*b* are views of a similar rocker assembly with coil spring elements arranged in a different manner.
Figure 7A:
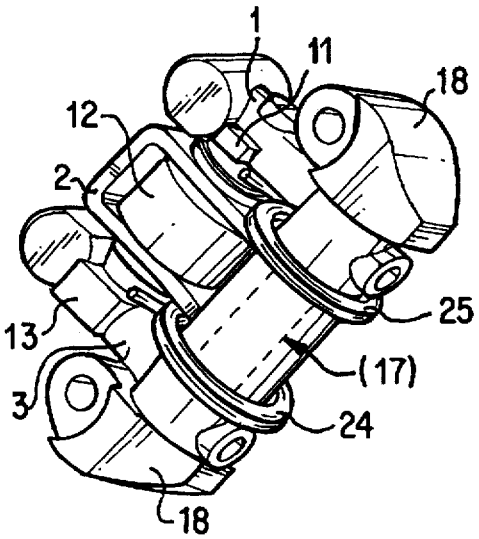
FIG. 7*a* is a perspective view from above.
Figure 8A:
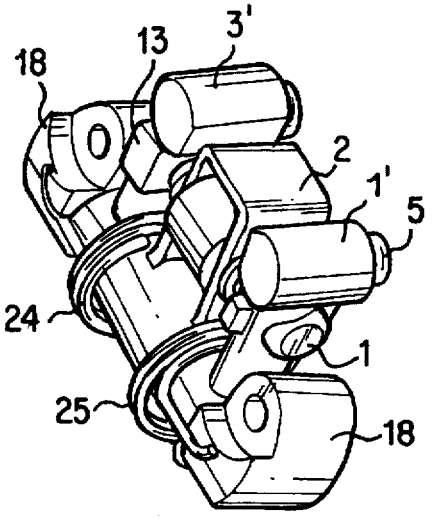

Within this rocker assembly, the hydraulic ducts 8 in the arms 1, 3 are supplied with hydraulic medium by way of hydraulic ducts 20, 22 in the shaft portion 17 or in the bearing bracket 18. Naturally, it is required to provide for each arm 1, 3 a separate hydraulic duct 20 as well as a separate hydraulic duct 22 if it is to be possible, as explained above, to couple each of these arms 1, 3 separately to the arm 2. For this reason, the two hydraulic ducts 20 are constructed in the rocker shaft portion 17 as separate branch ducts which are apart from one another. Each of the two branch ducts or hydraulic ducts 20 is supplied with hydraulic medium by way of the supporting bracket 18 adjoining it or by way of the hydraulic duct 22 provided therein. In this case, the hydraulic ducts 20 of the supporting brackets 18 are connected with different supply ducts 21, 23 which extend essentially side by side in the cylinder head 19 of the internal-combustion engine, as illustrated in FIGS. 5, 6. The supporting bracket 18 which is adjacent to the arm 1 is connected by means of its hydraulic duct 22 to the supply duct 21, while the supporting bracket 18 adjacent to the arm 3 is connected by means of its hydraulic duct 22 to the supply duct 23.

The embodiments according to FIGS. 7*a*, 7*b*, 8*a*, 8*b* also show coil spring elements 24, 25 which are guided through the sections of the arms 1, 2, 3 concentrically to the rocker axis 4. In both embodiments, one end of the coil spring elements 24, 25 is supported on the rocker arm 2. In the embodiment according to FIGS. 7*a*, 7*b*, the other end of the coil spring elements 24, 25 is supported on the other, respectively adjacent rocker arm 1 or 3. In the embodiment according to FIGS. 8*a*, 8*b*, the other end of the coil spring elements 24, 25 is, in each case, supported on the adjacent supporting bracket 18.

It is a significant purpose of these coil spring elements 24, 25 to press the rocker arm 2 against the cam assigned to this arm 2 when this arm 2 is not coupled to one of the two other arms 1, 3. These coil spring elements 24, 25 are therefore used particularly for the precise positioning of the rocker arm 2. In the embodiment according to FIGS. 8*a*, 8*b*, these two coil spring elements 24, 25 also hold the rocker assembly together so that the latter may be constructed as a preassembly unit.

Although the invention has been described and illustrated in detail, it is to be clearly understood that the same is by way of illustration and example, and is not to be taken by way of limitation. The spirit and scope of the present invention are to be limited only by the terms of the appended claims.

We claim:

1. A rocker assembly for actuating at least two lifting valves of an internal-combustion engine comprising:

a plurality of rocker arms which can each be swivelled independently about a rocker shaft portion having a rocker axis, said rocker arms each having a contact surface for a cam, said rocker arms comprising a central arm and two outer arms;

a coupling bolt arranged in each of said two outer arms, said coupling bolts being hydraulically displaceable in a direction essentially parallel to said rocker axis to interconnect a respective said outer arm with said central arm;

a spring-loaded restoring bolt corresponding to each said coupling bolt, said spring-loaded restoring bolts being arranged in said central arm; and a plurality of supporting brackets configured to support at least one of said rocker shaft portion and said rocker arms wherein hydraulic ducts extend through said supporting brackets said rocker shaft portion and said outer arms to communicate with said coupling bolt, and wherein said rocker arms, said rocker shaft portion and said supporting brackets form a preassembly unit.

2. A rocker assembly according to claim 1, wherein the contact surface of the central arm is constructed as a rotatable roller.

3. A rocker assembly according to claim 2, wherein the spring-loaded restoring bolts are arranged coaxially within the roller.

4. A rocker assembly according to claim 1, wherein at least one coil spring element is arranged essentially coaxially with respect to the rocker axis, is supported at a first end on the central arm, is supported at a second end on one of the outer arms, and is configured to bias the central arm against the cam assigned thereto.

5. A rocker assembly according to claim 1, wherein the cam contact surfaces of the outer arms are constructed as sliding pads.

6. A rocker assembly according to claim 1, wherein at least one coil spring element is arranged essentially coaxially with respect to the rocker axis, is supported at a first end on the central arm, is supported at a second end on one of the supporting brackets, and is configured to bias the central arm against the cam assigned thereto.

7. A rocker assembly according to claim 1, wherein said hydraulic ducts communicate said coupling bolts with at least one hydraulic pressure source for hydraulic displacement of said coupling bolts.

8. A rocker assembly according to claim 7, wherein one of said coupling bolts is communicated with a first of said hydraulic pressure sources, and wherein the other of said coupling bolts is communicated with a second of said hydraulic pressure sources.

9. A rocker assembly according to claim 1, wherein a first of the supporting brackets is arranged at one axial end of said rocker shaft portion, and a second of the supporting brackets is arranged at the other axial end of said rocker shaft portion.

10. A rocker assembly according to claim 9, wherein said first and second supporting brackets are arranged outside of said plurality of rocker arms in an axial direction with respect to said rocker shaft portion.

11. A rocker assembly according to claim 9, wherein each of said rocker arms includes a rocker shaft engaging portion which swivellably engages said rocker shaft portion, said first of the supporting brackets being arranged adjacent and axially outside of said rocker shaft engaging portion of one of said outer arms, and said second of the supporting brackets being arranged adjacent and axially outside of said rocker shaft engaging portion of the other of said outer arms.

12. A rocker assembly formed as a preassembly unit which is attachable as a subassembly to a cylinder head of an internal-combustion engine, comprising:

a rocker shaft portion defining a rocker axis and having a first axial end and a second axial end;

a first supporting bracket supporting said first axial end of the rocker shaft portion;

a second supporting bracket supporting said second axial end of the rocker shaft portion;

a plurality of rocker arms arranged on said rocker shaft portion between said first supporting bracket and said second supporting bracket, each of said rocker arms being independently swivellable about the rocker shaft portion, said rocker arms each having a contact surface for a cam, said rocker arms comprising a central arm and two outer arms;

a coupling bolt arranged in each of said two outer arms, said coupling bolts being hydraulically displaceable in a direction essentially parallel to said rocker axis to interconnect a respective said outer arm with said central arm; and a spring-loaded restoring bolt corresponding to each said coupling bolt, said spring-loaded restoring bolts being arranged in said central arm, wherein at least one hydraulic pressure source is communicated with said coupling bolts via hydraulic ducts which extend through said supporting brackets, said rocker shaft portion and said outer arms, in order to selectively displace said coupling bolts to interconnect said arms.

13. A rocker assembly according to claim 12, wherein a first hydraulic pressure source is communicated with one of said coupling bolts via a first set of hydraulic ducts which extend through a respective one of said supporting brackets, said rocker shaft portion, and a respective one of said outer arms, and wherein a second hydraulic pressure source is communicated with the other of said coupling bolts via a second set of hydraulic ducts which extend through the other of said supporting brackets, said rocker shaft portion and the other of said outer arms, said first set of hydraulic ducts being separate from said second set of hydraulic ducts.

* * * * *